US005346183A

United States Patent [19]

Westley

[11] Patent Number: 5,346,183

[45] Date of Patent: Sep. 13, 1994

[54] FUMELESS CUPOLAS

[75] Inventor: David R. Westley, Wolverhampton, England

[73] Assignee: The BOC Group plc, Windlesham, England

[21] Appl. No.: 135,218

[22] Filed: Oct. 12, 1993

Related U.S. Application Data

[62] Division of Ser. No. 3,899, Jan. 13, 1993, Pat. No. 5,309,232.

[30] Foreign Application Priority Data

Jan. 31, 1992 [GB] United Kingdom ..... 9202073.4

[51] Int. Cl.[5] ..... C21C 7/00

[52] U.S. Cl. ..... 266/197; 75/574; 75/581

[58] Field of Search ..... 75/574, 581; 266/197

[56] References Cited

U.S. PATENT DOCUMENTS 3,418,108 12/1968 von Stroh ..... 75/574
3,603,571 9/1971 Geiger ..... 75/581
3,759,699 9/1973 Geiger ..... 75/574
4,324,583 4/1982 Hamilton .

FOREIGN PATENT DOCUMENTS 860989 10/1939 France .
914904 1/1963 United Kingdom .
1500511 2/1978 United Kingdom .
1599356 9/1981 United Kingdom .

*Primary Examiner*—Peter D. Rosenberg
*Attorney, Agent, or Firm*—David A. Draegert; Larry R. Cassett

[57] ABSTRACT

A hot coke bed is established at the bottom of a vertical shaft furnace, e.g. an iron melting cupola. The cupola is then charged with alternate layers of ferrous metal and coke material, respectively. Burners burn hydrocarbon fuel in the presence of a stoichiometric excess of oxygen-enriched air and thus form a hot gas mixture including oxygen. The hot gas mixture passes upwards through the shaft of the cupola thereby providing sufficient heat to melt the ferrous metal. Molten ferrous metal flows downwards under gravity into and through the coke bed and may be removed through a tap hole. At least one jet of oxygen is injected into the hot coke bed so as to maintain it at a temperature sufficient to superheat the molten metal. Preferably a fan is operated to dilute with air the combustion gases above the level of the charge in the shaft and thereby create secondary flames. No air blast is supplied to the cupola. A significant degree of superheating can be achieved while keeping down the proportion of environmentally undesirable components (i.e. particulates and carbon monoxide) in the gas exhausted from the cupola.

4 Claims, 2 Drawing Sheets

FUMELESS CUPOLAS

This application is a division of Ser. No. 08/003,899, filed on Jan. 13, 1993, and now U.S. Pat. No. 5,309,232.

TECHNICAL FIELD

This invention relates to the operation of vertical shaft furnaces so as to melt metal. The invention is particularly concerned with the operation of cupolas to melt ferrous metal.

BACKGROUND OF THE PRIOR ART

Cupolas are widely used in foundries to melt pig iron, iron scrap and steel scrap or mixtures thereof. In order to operate a conventional cupola, a red hot bed of coke is established at its bottom. The coke bed is maintained at the desired temperature by supplying an air blast through tuyeres that direct the air at relatively low velocity into the bed. A charge comprising alternate layers of metal to be melted and coke is fed into the shaft of the cupola. Hot gases created by the exothermic reaction of the air blast with the coke bed flow upwards through the shaft of the cupola and heat the metal by convection sufficiently for a region of molten metal to be created immediately above the coke bed. The molten metal percolates through the coke bed and is superheated by radiation from the coke. From time to time molten metal is tapped off from the bottom of the cupola into a ladle for use in the foundry. Alternatively, the molten metal may be continuously tapped and collected in a suitable receiver. Although the coke in the bed is progressively consumed by the reaction with the oxygen component of the air blast, the coke layers in the charge will replenish the bed and the coke bed is maintained at adequate depths throughout the operation of the cupola. It is also conventional to include within the charge limestone or other slag-forming agent, ferrosilicon or other suitable ferroalloys so as to improve the metallurgical properties of the metal during the melting operation.

A wide range of different variants of this basic method of operating a cupola are Known. For example, the air blast can be provided without being pre-heated. Cupolas that operate in this way are Known as cold-blast cupolas. Alternatively, the air blast can be pre-heated. Such cupolas are Known as "hot blast" cupolas. If desired, the air blast may be enriched with oxygen so as typically to raise the oxygen concentration of the air by from 2 to 4% by volume. More preferably, the oxygen may be introduced into the coke bed in the form of high velocity jets through lances. The lances may be located below the tuyeres (see GB-A-914 904) or may project through the tuyeres themselves. (See GB-A-1 006 274). As disclosed in EP-A-56 644 the oxygen jets may each enter the cupola at above sonic velocity. All the variants described above that make use of oxygen offer two main advantages. First, they enable higher temperatures to be created wi thin the cupola and thus enable the molten metal to be discharged at a higher temperature. Second, they enable the rate of melting metal to be increased.

It has been proposed in GB-A-1 500 511 to modify a conventional air blast cupola by adding to it oxy-fuel burners so as to provide additional heating to melt the metal. Accordingly, there is a reduced need for heat to be generated by the reaction between the air blast and the coke bed. As a result, the amount of coke in the charge can be reduced.

All the methods of operating cupolas described above suffer from a common disadvantage, namely that there is emitted from the top of the cupola a visible smoke or fume which is heavily laden with particles. Although it is possible to treat such smoke or fume to reduce its content of particles so as to render it less unsuitable for discharge to the atmosphere, the cost of so doing is high. There is therefore a growing demand for methods of operating cupolas which do not inevitably have associated therewith the production of a visible, particulate-laden fume.

In order to meet this demand there has been developed a cupola which uses neither an air blast nor coke. Instead, it employs air-fuel burners to melt the ferrous metal by convection heating, and a bed of ceramic balls to superheat the molten metal by radiant heat. The bed of ceramic balls is supported on a water-cooled grid. Immediately below the grid is a cavity into which the burners fire. The hot combustion gases ascend the furnace, heating the ceramic balls and melting the ferrous metal. The resulting molten metal falls through the ceramic balls and is superheated by heat radiated therefrom. There is thus no need to include any coke in the charge to the cupola, and provided that the ferrous metal in the charge is free of oil or other such contaminants, no visible fume is emitted. In practice, there have found to be a number of disadvantages associated with the operation of such cupolas. First, difficulties arise in producing molten metal at an adequate temperature. Moreover, the water-cooled grid tends to be damaged if excessive temperatures are created within the cupola. It has also been found that increased additions of ferrosilicon are required in order to ensure that a molten ferrous metal having a desired silicon content is given. Similarly, it is necessary to add carbon, typically in the form of graphite, to the molten metal to give a desired carbon content now that coke is no longer employed in the charge. Furthermore, the ceramic balls have a limited life as they tend to be eroded by the molten metal. There is therefore a need continuously to replace the balls, much in the same way as it is required in a conventional air blast cupola to include coke in the charge so as to replace the coke that is consumed by reaction with oxygen in the bed at the bottom of the cupola.

There is therefore a need for an alternative method of operating a cupola which does not of necessity entail the emission of large quantities of visible, particle-laden, fume from the furnace yet which facilitates the production of metal, particularly ferrous metal, at a temperature suitable for the direct casting of engineering iron without the need for an additional heating facility such as an electric duplexing furnace.

SUMMARY OF THE INVENTION

According to the present invention there is provided a method of operating a vertical shaft furnace comprising, establishing a hot coke bed in a bottom region of the furnace; charging the furnace with metal to be melted and with coke; burning at least one stream of fuel with a stoichiometric excess of oxygen over that required for complete combustion of the fuel and thereby forming a hot gas mixture Including oxygen; introducing the hot gas mixture into the shaft furnace and allowing it to pass upwardly through the charge in the furnace, oxygen in the hot gas mixture thereby reacting with the coke charge such that a part of the coke charge is consumed, heat being provided to the metal by the hot gas mixture and by the said reaction between the oxygen and the coke being sufficient to melt the metal without there being an air blast supplied to the furnace, and the molten metal so formed flowing downwardly under gravity through the hot coke bed; introducing at least one jet of oxygen or oxygen-enriched air into the said hot coke bed so as to maintain the bed at a temperature sufficient to superheat the molten metal as the molten metal passes through the hot coke bed; and discharging superheated molten metal from the furnace.

The invention also provides a vertical shaft furnace having associated therewith means operable to inject at least one jet of pure oxygen or oxygen-enriched air into a coke bed maintained in operation of the furnace at a bottom region thereof; at least one fuel burner operable with a stoichiometric excess of oxygen over that required for complete combustion of the fuel to form a hot gas mixture comprising combustion products and oxygen, said at least one burner being positioned so as, in use, to direct the hot gas mixture into the furnace shaft and thereby to enable it to pass upwardly through the charge in the furnace such that oxygen in the hot gas mixture is able to react with the coke charge to consume a part of the coke charge to be consumed and thereby generate an amount of heat which with the heat available from the hot gas mixture is able to melt the metal, molten metal so formed being able to flow downwardly through the hot coke bed and to be superheated by the coke in said bed; and means for discharging molten metal from the furnace, wherein the furnace has no means for supplying an air blast to it.

We have surprisingly found that when employing the method and apparatus according to the invention to melt ferrous metal in a cupola, there is surprisingly little visible fume emitted in comparison with conventional hot blast and cold blast cupolas. Although we do not fully understand why this result is obtained, we attribute it to an ability through the combustion of said at least one stream of fuel to generate a high temperature stream of oxygen-containing gas mixture. This gas mixture is typically produced at a temperature of from 900° to 1100° C. Such temperatures are well in excess of those at which the air enters the shaft of a conventional hot-blast or cold-blast cupola. The high temperature oxygen-containing gas mixture is, we believe, conducive to the creation in the shaft of the cupola of conditions in which gas-borne particles of coke are more readily oxidized to gaseous products than in conventional hot-blast or cold-blast cupolas with the result that the amount of visible fume emitted from the cupola shaft is kept down. We obtain our best results when diluting with air (or other oxygen-containing gas) the hot gas mixture at a level above the charge (so as to promote combustion of carbon monoxide and any carbon particles in the hot gas) and when operating the burner or burners not only with excess air but also with oxygen-enrichment of the combustion air.

The method and apparatus according to the invention are able to be operated so as to create in the furnace shaft a regime of a sufficiently high temperature for the molten metal to be produced with a sufficient degree of superheat, that is at a temperature sufficiently above the melting point of the metal, for the metal to be readily transferable to other vessels for immediate use in a foundry to make castings or the like. In particular, we have found it possible when melting ferrous metal to tap the metal at temperatures of 1500° C. or above. Such temperatures are generally recognized with the art to be adequate for most uses of molten ferrous metal within a foundry.

A third major advantage of the method and apparatus according to the invention is that the temperature of the molten metal being tapped is to a large extent able to be controlled independently of the melting rate: there is considerable flexibility of operation such that the production of molten metal can be adjusted within a broad range of production rates independently of the tap temperature.

The advantages and preferred features of the invention are discussed further hereinbelow.

The fuel is preferably a liquid or gaseous hydrocarbon. For example, the fuel may be propane or a fuel oil. Combustion of the fuel preferably takes place with a relatively large amount of excess air, typically from 20 to 100%, and thereby provides sufficient oxygen in the hot gas mixture to oxidize coke at a desired rate. The melting rate of the metal is determined by the rate of transfer of heat from the combustion gases to the metallic charge and the rate at which the oxygen in the combustion gases burns out the coke. Hence, for a given coke charge and rate of fuel supply, the melting rate is determined by the amount of oxygen in the hot gas mixture leaving the burner or burners. Accordingly, the rate of melting may be increased by increasing the amount of excess air employed, and decreased by decreasing this amount. The tap temperature of the molten metal may be independently controlled by the rate at which the jet or jets of oxygen or oxygen-enriched air are injected into the coke bed. Such independent control of the melting rate and tap temperature is facilitated by arranging for the burner or burners to direct hot gases into the furnace at a level appreciably above that of the injection of the or each jet of oxygen or oxygen-enriched air. The difference in height between such levels is typically in the order of 0.5 m or more. Typically, the ratio by weight of coke to metal in the charge is in a range of from 4 to 8% when melting ferrous metal. This ratio excludes coke added to the furnace to establish the bed prior to the introduction of metal and is smaller than that generally employed in conventional cold blast cupolas. In general, for a given amount of excess air, the rate of melting decreases with increasing coke to metal ratio. Control of the melting rate may also be effected by varying the rate of supply of fuel to the burner or burners.

Preferably, a plurality of spaced-apart burners is employed so as to impart essentially uniform cross-sectional heating to the charge.

We have found that the burners may simply each extend into a passage through the wall of the furnace without creating an unacceptable rate of erosion of the furnace lining or an unstable flame. If desired, however, the or each burner may fire into a separate combustion chamber outside the furnace which communicates with the shaft of the furnace. The use of such an external combustion chamber although helping to reduce the rate of furnace lining erosion can entail some loss of temperature in the hot gas mixture and is generally therefore not preferred.

According to a preferred feature of the invention, the hot gas mixture has a temperature and oxygen content sufficient for the molten metal to be superheated before it encounters the said coke bed at the bottom region of the furnace. Such superheating limits the amount of additional superheating that needs to be provided by the hot coke bed, and hence limits the amount of heat that needs to be generated in the coke bed. This tn turn reduces the rate at which oxygen or oxygen-enriched air needs to be injected into the bed which tends to reduce the temperature which is created at the interface between the bed and the furnace wall, thereby reducing the rate of erosion of the lining on the wall.

A secondary flame or flames are typically created by the dilution air (or other oxygen-containing gas) within the shaft of the furnace above the charge. We have found that the presence of such secondary flames in the region of the shaft immediately above the charge reduces the amount of carbon monoxide in the gaseous mixture leaving the shaft of the furnace. Typically, when air is used to support combustion of the fuel supplied to the or each burner, the level of carbon monoxide is found to be in the order of 5 to 6% by volume at a sampling point a little below the gas outlet from the furnace. The air that supports the combustion of the fuel is however preferably enriched in oxygen. Preferably, the enrichment increases the oxygen content of the air to a value of up to 26% by volume. Such oxygen-enrichment increases the temperature of the hot combustion gases and facilitates reaction between the dilution air and residual combustibles therein above the level of the charge. Indeed, we have by this means found it possible to eliminate the emission of visible fume from the furnace, and to reduce the aforesaid carbon monoxide concentration to less 1%. We have further found that enriching in oxygen the air employed to support combustion of the fuel stream or streams also facilitates superheating of the molten metal. Care needs to be taken, however, when so employing oxygen-enriched air to avoid creating so high a flame temperature that local erosion of the furnace lining proceeds at such a rate that damage is done to the structure of the furnace or that the lining is eroded at an unacceptable rate.

Enrichment of the combustion air is preferably performed by mixing it with oxygen upstream of the flame zone of the or each burner. Direct inflection of the oxygen into the or each burner flame is however also possible.

The source of some of the dilution air is typically a door in the furnace through which the charge is loaded. Additional air is preferably provided by a fan which has an outlet in communication with the shaft at a level about that of the charge but below that of the door.

Preferably, the shaft of the furnace is pre-heated by operation of said at least one burner prior to charging of the furnace. Typically, the or each burner is operated for up to an hour before charging is commenced. It is also preferred to bring the bed of coke to its desired operating temperature before charging of the furnace is started. Accordingly, the bed is preferably ignited to establish an elevated temperature and then said injection of oxygen commenced prior to the charging of the furnace.

Whereas the combustion of the stream of fuel provides all the necessary need for the melting of the metal and preferably for some superheating of the molten metal, the injection of the oxygen or oxygen-enriched air into the coke bed as aforesaid provides a means for controlling the discharge temperature of the molten metal. The rate at which oxygen needs to be injected is not particularly great. Typically, such rate is from 0.5 to 5%. preferably 1.0 to 2.5%, of the rate at which air is supplied for the purposes of supporting combustion of the fuel. It is however preferred that the oxygen be injected at particularly high velocity, say, at least 100 m/s and preferably at sonic or supersonic velocity depending on the diameter of the furnace. It is also preferred that the oxygen be injected generally horizontally in a plane perpendicular to the longitudinal axis of the shaft of the furnace to ensure that the oxygen can penetrate the central regions of the bed of coke and thereby enable a high temperature to be created in the center of the bed while at the same time minimizing the flow of unreacted oxygen into the charge above the bed. Preferably a plurality of spaced apart lances are used to inject the oxygen into the bed. Each lance preferably has such an internal diameter that enables the preferred velocity to be created. Each lance may terminate at the interface between the coke bed and the wall of the furnace. Alternatively, each lance may communicate with the coke bed via a passage of diameter similar to or the same as the internal diameter of the lance itself. Such an arrangement helps to minimize erosion of the lances in use.

It is not essential that the oxygen be supplied to the coke bed continuously during operation of the furnace to melt metal. Even if continuous operation is not desirable from the metallurgical point of view, however, it is sometimes desirable that oxygen be supplied continuously through each lance so as to prevent blockages occurring. We therefore prefer to vary the rate of oxygen injection from a maximum to a minimum rate. Preferably the oxygen is supplied from a commercially pure source thereof.

Alternatively, the source of oxygen may be oxygen-enriched air. Preferably the proportion of oxygen in the oxygen-enriched air is at least 50% by volume, and most preferably it is at lest 90% by volume.

The metal and coke are preferably charged to the furnace in alternate layers. If desired, additional constituents may be included in the charge, for example a slagging agent such as limestone or other form of calcium carbonate. An alloying substance such as silicon, for example in the form of ferrosilicon may also be included.

A cupola may be built to custom for operation by the method according to the invention. Alternatively, a furnace originally adapted to be operated by another method may be converted to operate the method according to the invention. An air blast cupola may be converted by locating air-fuel burners in the tuyeres themselves and using the air source to supply the burners rather than the tuyeres and, if not already provided, by fitting lances for the injection of oxygen.

BRIEF DESCRIPTION OF THE DRAWINGS

The method according to the invention will now be described by way of example with reference to the accompanying drawings, in which.

Figure 1:
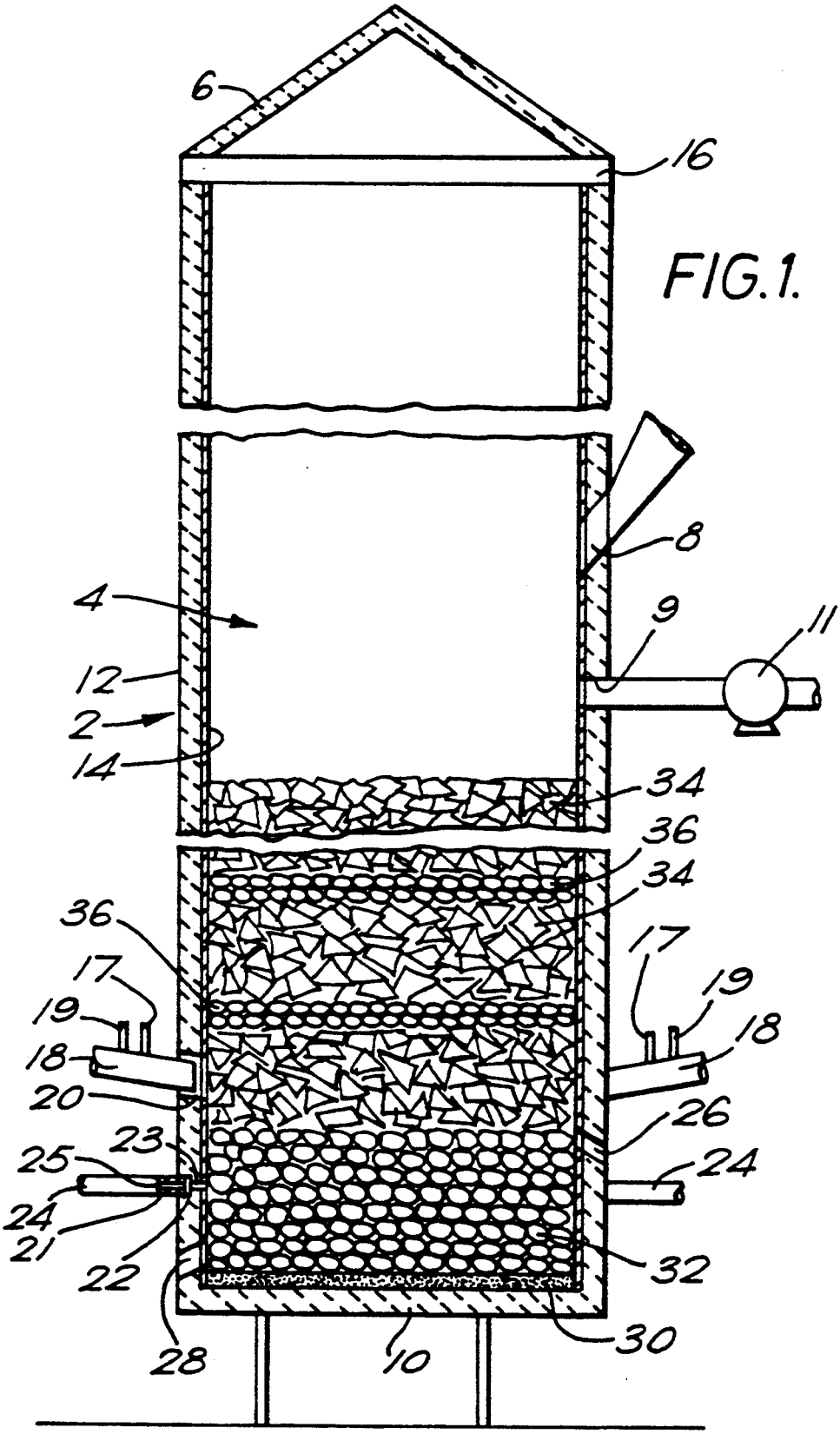
FIG. 1 is a schematic side elevation, partly in section, of a cupola.

The drawings are not to scale.

DETAILED DESCRIPTION OF THE INVENTION

Referring to the drawings, a cupola 2 has a vertical shaft 4 extending between a floor 10 and an arrester 6. The shaft 4 is defined by a cylindrical wall 12 formed of refractory brick with an inner refractory lining 14 typically of a silica-based refractory. Near the top of the cupola 2 there is an outlet 16 for hot gases. The furnace 2 has a charge door B formed in its wall. Below the level of the charge door 8 a plurality of air inlets q is formed through the wall 12 and each inlet 9 communicates with a fan 11 which in operation draws in air from outside the furnace.

Figure 2:
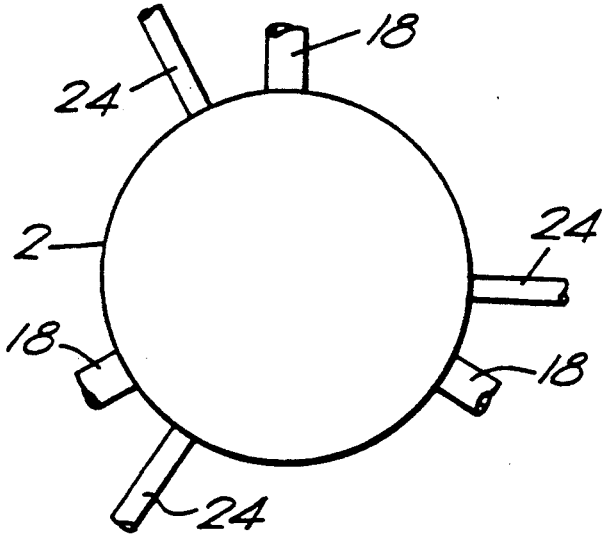
FIG. 2 is a schematic plan view of the cupola shown in FIG. 1.

The cupola 2 is provided with three air-oil burners 18 which, in use, fire into the cupola 2 through respective ports 20 in the wall 12. As shown in FIG. 2, the burners 18 are equally spaced about the circumference of the wall 12. In addition, the ports 20 are at the same level as one another, each having an axis extending downwardly from the outer surface to the inner surface of the wall 12 at an angle of about 10° to the horizontal though this angle is not critical. Each burner 18 is provided with an inlet 17 for oxygen-enriched air and an inlet 19 for hydrocarbon fuel.

The wall 12 has formed therethrough three circumferentially disposed apertures 22 at a level beneath the ports 20. Each aperture comprises an outer bore 21 of relatively wide diameter and an inner counterbore 23 of relatively narrow diameter. Each aperture 22 receives the distal end of a lance 24 in the bore 21. Each lance 24 has a relatively narrow passage 25 formed therethrough of the same diameter as the counterbore 23 of its respective aperture 22. Each lance 24 is positioned such that its passage 25 is contiguous to and coaxial with the counterbore 23 of the associated aperture 22. As shown in FIG. 2, the lances 24 are equally spaced around the circumference of the wall 12. The axes of the apertures 22 and the lances 24 are preferably horizontally disposed.

The cupola is provided with a slag hole 26 in the wall 12 of the shaft 4 through which, in operation, slag formed during the metal melting process can be run off. Beneath the slag hole 26 is a tap hole 28 formed through the wall 12 of the shaft 4 of the cupola 2. In operation, the molten metal can from time to time be tapped off through the tap hole 28. Other arrangements for tapping slag and molten metal can alternatively be provided. For example, slag and metal can both be continuously tapped via a conventional front slagging box (not shown).

In order to operate the cupola shown in FIGS. 1 and 2, the lances 24 are connected to a source (not shown) of commercially pure oxygen and the burners 18 are connected to a source (not shown) of oil and a source (not shown) of air. A bed 30 of silica sand is established on the floor 10 of the shaft 4 up to the level of the bottom of the tap hole 28. A bed 32 of coke is then established up to the level of the bottom of the ports 20 by introducing coke into the cupola 2 through the door 8. The bed 32 is then ignited by means of a gas poker (not shown) that can be introduced into the bed through a bottom door (not shown) in the wall 12 of the cupola 2. This door may be left open to enable a flow of air to be induced into the coke bed so as to support combustion. Alternatively, such air flow can be induced through the slag hole 26. The coke is then consolidated using a rabble (not shown) and the bed 32 topped up with fresh coke to the level of the bottom of the ports 20. Next, operation of the burners 18 is started. The burners are capable of being operated with up to 100% excess air, that is to say with air at a rate up to 100% in excess of the stoichiometrtc rate required for complete combustion of the fuel. The walls 12 of the shaft 4 of the cupola 2 are pre-heated by hot combustion products from the burners 18 for a period of 30 minutes. During this period no excess air is supplied to the burners 18. Five minutes before the end of this period, injection of pure oxygen into the coke bed 32 via the lances 24 and the counterbores 23 of the apertures 22 is commenced. (At the same time the air flow to the coke bed is cut off by closing the bottom door or the slag hole 26, as the case may be.) The injection of oxygen into the coke bed 32 accelerates the rate of combustion of coke and causes its temperature to rise rapidly. During the final five minutes of pre-heating the coke bed is made up again to the level of the ports 20. At the end of pre-heating, the cupola 2 is loaded through the door 8 with a charge comprising iron and steel, ferrosilicon, coke and limestone or other slagging agent. This charging is performed such that layers 34 of ferrous metal alternate with coke layers 36. The limestone is included in the layers 34 and the ferrosilicon is included in the layers 36. The top layer of the charge is arranged to be below the level of the air inlet 9.

In operation of the cupola 2 to melt the ferrous metal, the combustion air to the burners 18 is preferably enriched in oxygen. In addition, the burners 18 are operated with up to 100% excess air. The flame from each burner typically extends into the shaft of the furnace. A hot gas mixture including oxygen leaves each flame and ascends the shaft 4, thereby heating the ferrous metal by convection. In addition, the oxygen in the hot gas mixture reacts with coke to generate additional heat. The resulting hot gas mixture emanating from the top of the charge is diluted with air by operation of the fan 11. Typically, secondary flames are thereby created, and these flames help to oxidize combustible gases in the hot gas mixture. The resulting gas, typically containing minimal visible fume, is vented from the cupola 2 through the outlet 16. The molten metal in the lowermost of the layers 34 begins to melt by virtue of being heated by the hot gas mixture leaving the burners. A region of molten metal is thus created at the level of the burners. The limestone reacts with ash in the coke to form a slag. The molten ferrous metal falls under gravity into the coke bed 32 and trickles therethrough. Typically, the molten ferrous metal is in a superheated state as it encounters the bed 32. During its residence in the coke bed 32 the molten ferrous metal is further superheated by radiant heat emanating from the coke which is maintained at a suitably high temperature by the continued injection of oxygen at high velocity into the bed 32. A small amount of the coke is dissolved in the molten ferrous metal, thereby increasing its carbon content and hence improving its metallurgical properties. In addition, the silicon also dissolves in the ferrous metal If desired, the carbon level of the ferrous metal in be further enhanced by direct introduction of graphite into the molten metal through a port (not shown) specially adapted for this purpose. If the temperature of the molten ferrous metal is suffiently high, there will also be reduction of silica at the interface between the coke and molten slag with the result that additional silicon is incorporated into the molten ferrous metal.

The molten metal and the slag may be periodically run off through the respective holes 28 and 26. It can therefore be appreciated that the charge will gradually sink downwards through the shaft 4. In addition, the reaction between the oxygen and the coke in the bed 32 will cause this bed gradually to be eroded. However, the height of the bed is restored each time melting of a layer 34 of ferrous metal has been completed and the resulting molten metal has passed into the coke bed 32 since the next coke layer 36 then merges with the bed 32. In order to enable molten metal to be produced throughout a chosen period of time, fresh charge is periodically loaded into the shaft 4 through the door 8.

It has been typically observed that tap temperatures in the order of 1500° C. have been maintained over a period of time, while being able to operate the cupola 2 with a maximum rate of production of molten ferrous metal some four times in excess of a minimum rate. Moreover, carbon monoxide levels of less than 1% by volume have been detected on the outlet 16, while no Smoke emissions have been observed. Other advantages that have been obtained include a reduced requirement for ferrosilicon and graphite additions.

The method according to the invention is further illustrated by the following examples:

EXAMPLE 1

A cupola was converted to the form shown in FIGS. 1 and 2. The cupola was of a capacity such that it was able to produce 4 tons of ferrous metal per hour. Its shaft 4 had an internal diameter of 27" and an external diameter of 48". The mouth of the tap hole 28 was located 8" above the floor 10 and the slag hole 26 a further 11" thereabove. The vertical distance from the floor 10 to the level of the bottom of each port 20 was approximately 48". Accordingly, the sand bed 30 had a depth of 8" and the coke bed 32 when first made up a depth of about 40". The counterbores 23 of the apertures 22 were formed at a level 15" below the top of the coke bed (when first made up). Each counterbore 23 had a diameter of 7 mm. The lances 24 were each formed of stainless steel and each had an internal bore of 7 mm.

The procedure described above with reference to FIGS. 1 and 2 was used for preparing the cupola 2 for charging. During the pre-heating period light fuel oil was supplied to the burners 18 at a total rate of 36 gallons per hour and air at approximately the stoichiometrtc rate required for complete combustion of the oil. Five minutes before the end of the pre-heating period the injection of oxygen at sonic velocity into the coke bed 32 was initiated but no oxygen was used to enrich the combustion air to the burners. The rate of supplying oxygen to the lances 24 was 1650 cubic feet per hour and the supply pressure was 150 psig. Five minutes after initiation of the oxygen injection, charging of the cupola was commenced. The charge consisted of 305 kg of ferrous metal pieces comprising 30 kg of pig iron, 125 kg of iron scrap, 120 kg of iron returned from the foundry and 30 kg of baled steel scrap; 2.75 kg of silicon added as ferrosilicon containing 70% Sl; 6.0 kg of limestone and 18.0 kg of coke. There were thus 5.9 parts by weight of coke for each 100 parts by weight of ferrous metal (excluding the ferrous metal added in the form of ferrosilicon). This charge was loaded in the form of a lower metal layer including the ferrosilicon and an upper coke layer including limestone.

The cupola was operated for a period of 5½ hours from the start of charging. From time to time molten ferrous metal was tapped off into a ladle and its temperature and composition measured. Similarly, from time to time fresh charge was introduced into the cupola to replenish the original charge. During operation, the oxygen flow rate to the lances was varied as was the rate of supplying air and oil to the burners. In each case, the flow regime was selected from two alternatives. For the oxygen supply to the lances 24, one alternative was as stated above (1650 cubic feet per hour at 150 psig) and the other alternative was 1100 cubic feet per hour at 100 psig. For the operation of the oil burners 18, one flow regime was 36 gallons per hour of oil and 1750 cubic feet per minute of air and the other alternative was 30 gallons per hour of oil and 1400 cubic feet per minute of air.

After operation for just over one hour, the silicon in the fresh charge was reduced to 1.5 kg. After 4 hrs 6 mins of operation no more charging of the cupola was performed.

The results obtained for some the ladles of ferrous metal taken during a period starting after 52 mins had elapsed from the start of charging and ending after 4 hrs 6 mins are set out in the Table below. The Table also includes the air, oil and oxygen flow rates that were being employed at the time each tapping was made.

TABLE

| Time | CE (%) | C (%) | Si (%) | T (°C.) (ladle) | O2 (cfh) | Oil (gph) | Air (cfm) |
|---|---|---|---|---|---|---|---|
| 0.52 | 4.30 | NM | 2.9 | 1480 | 1100 | 30 | 1400 |
| 1.02 | 4.21 | 3.5 | 2.9 | 1460 | 1100 | 30 | 1400 |
| 1.25 | 3.92 | 3.28 | 2.68 | 1450 | 1650 | 30 | 1400 |
| 1.37 | 3.81 | 3.24 | 2.40 | 1440 | 1650 | 30 | 1400 |
| 3.30 | 4.12 | 3.55 | 2.45 | 1450 | 1110 | 36 | 1750 |
| 3.54 | 4.19 | 3.60 | 2.54 | 1450 | 1110 | 36 | 1750 |
| 4.06 | 4.18 | 3.60 | 2.48 | NM | 1110 | 36 | 1750 |

NM = Not Measured
CE = % C + 0.25 × % Si + 0.5 × % P

It was found that high tap out temperatures were obtained throughout the melting period, that less ferrosilicon was required to give a given silicon level in the tapped-out metal, and that high carbon values were obtained with graphite addition only during the first 20 rains of the melting period. Moreover, the graphite injection port was maintained operational throughout the whole melting period without becoming blocked. It was observed that the emissions of fume from the cupola were not visible for most of the day and were considered to be at least as good as those obtained by operation of cupolas heated entirely by burners without any coke being present. Furthermore, the lances 24, which did not have water cooling, were undamaged at the end of the melting period. Some wear to the refractory lining did occur particularly in the vicinity of the counterbore 23 of each aperture 22. The wear was nevertheless tolerable and could easily be repaired before the cupola was used again. It can therefore be seen that to the invention makes it possible to achieve considerable operating advantages over previously practised method.

EXAMPLE 2

The procedure of Example 1 was generally followed but this time the air supplied to the burners was enriched in oxygen.

The charge had the following composition:

| | |
|---|---|
| Pig Iron | 35 Kg |
| Returns | 110 Kg |
| Cylinder Scrap | 130 Kg |
| Steel | 30 Kg |
| | 305 Kg |
| Coke | 18 Kg |
| Si | 2.25 Kg as 70% FeSi |

Oxygen was supplied to the burners during melting at an approximate rate of 400 $ft^3$/hr. The rate of injection of oxygen into the coke bed was varied between 1,000 $ft^3$/hr and 1200 $ft^3$/hr. The aim was to produce molten metal in the ladle having a temperature of at least 1400° C.

The following results were achieved.

| | | | Metal Composition | | |
|---|---|---|---|---|---|
| Time | Oil gph | Air cfm | C % | Si % | T ° C. Ladle |
| 8.00 | 30 | 1575 | 3.50 | 2.40 | 1440 |
| 8.30 | 30 | 1575 | 3.49 | 2.47 | 1430 |
| 9.00 | 30 | 1750 | 3.40 | 2.41 | 1410 |
| 9.25 | 30 | 1750 | 3.49 | 2.31 | 1430 |
| 9.40 | 24 | 700 | | | |
| 10.00 | 24 | 700 | 3.48 | 2.35 | 1410 1st ladle |
| 10.05 | 18 | 875 | | | 1440 2nd ladle |
| 10.20 | 27 | 1575 | | | |
| 11.05 | 30 | 1750 | 3.41 | 2.80 | 1460 |
| 11.15 | 30 | 1750 | 3.43 | 2.29 | 1425 |
| 11.40 | 30 | 1750 | 3.50 | 2.24 | 1420 |
| 11.45 | 27 | 1400 | 3.38 | 2.67 | 1415 |
| 12.05 | 24 | 1400 | | | 1415 |
| 12.29 | 27 | 1050 | 3.59 | 2.21 | |

In addition, the CO level was measured at 0.3% by volume at 1 m below the outlet 16. No smoke was observed in the gas passing out of the cupola.

The variations in the rate of supply of oil and air to the burners in Examples 1 and 2 enabled large variations to be made in the rate of melting the ferrous metal. For example, the average metal melting rate between 11:05 and 11:45 hrs was 3.66 tons per hour, while between 9:40 and 10:05 hrs it was sufficiently low that there was no need to tap any molten metal from the furnace during this period. The rate of injection of oxygen into the coke bed could be varied to ensure that an adequate tap temperature was obtained.

Although the invention has been described with reference to specific example, it will be appreciated by those skilled in the art that the invention may be embodied in any other form.

I claim:

1. A vertical shaft furnace for melting a metal in the absence of an air blast comprising:

(a) a bed of coke material maintained in a bottom region of the furnace;

(b) means for introducing the metal to the coke bed to form a charge;

(c) at least one fuel burner for generating a hot gas mixture from a fuel and oxygen in an amount greater than a stoichiometric amount needed for complete combustion of the fuel;

(d) said at least one fuel burner adapted to direct the hot gas mixture towards the coke material to thereby generate sufficient heat to melt the metal and allow the molten metal to flow downwardly through the coke bed;

(e) means located below the at least one fuel burner for injecting an oxygen containing gas into the coke bed; and (f) means for discharging the molten metal from the furnace.

2. A vertical shaft furnace as claimed in claim 1 wherein the oxygen containing gas is selected from substantially pure oxygen and oxygen-enriched air.

3. A furnace as claimed in claim 1, in which the burner or burners fire directly into the furnace.

4. A furnace as claimed in claim 1, further comprising a fan or blower for diluting said hot gas mixture above the furnace charge.

* * * * *

UNITED STATES PATENT AND TRADEMARK OFFICE

CERTIFICATE OF CORRECTION

PATENT NO. : 5,346,183

DATED : September 13, 1994

INVENTOR(S) : David R. Westley

It is certified that error appears in the above-indentified patent and that said Letters Patent is hereby corrected as shown below:

On the title page, INID Code [62], correct the U.S. patent number to read: —Division of Serial No. 3,899, January 13, 1993, Patent No. 5,304,232.—

Column 1, line 5, U.S. Pat. No. 5,309,232 should read —U.S. Pat. No. 5,304,232—.

Signed and Sealed this

Fifteenth Day of November, 1994

Bruce Lehman

*Attest:*

BRUCE LEHMAN

*Attesting Officer*

*Commissioner of Patents and Trademarks*